US007649436B2

(12) United States Patent
Nakano

(10) Patent No.: US 7,649,436 B2
(45) Date of Patent: Jan. 19, 2010

(54) VARISTOR BODY AND VARISTOR

(75) Inventor: Mutsuko Nakano, Tokyo (JP)

(73) Assignee: TDK Corporation, Tokyo (JP)

( * ) Notice: Subject to any disclaimer, the term of this patent is extended or adjusted under 35 U.S.C. 154(b) by 392 days.

(21) Appl. No.: 11/727,512

(22) Filed: Mar. 27, 2007

(65) Prior Publication Data

US 2007/0229209 A1 Oct. 4, 2007

(30) Foreign Application Priority Data

Mar. 31, 2006 (JP) ..... 2006-098786

(51) Int. Cl.
*H01C 7/10* (2006.01)

(52) U.S. Cl. ..... 338/21; 338/223; 338/52

(58) Field of Classification Search ..... 338/21, 338/223, 224, 20, 13, 52, 54, 83; 361/305, 361/303, 311, 315
See application file for complete search history.

(56) References Cited

U.S. PATENT DOCUMENTS 5,369,390 A * 11/1994 Lin et al. ..... 338/21
5,854,586 A * 12/1998 McMillan et al. ..... 338/21
6,100,785 A * 8/2000 Kato et al. ..... 338/20
6,184,770 B1 * 2/2001 Nakamura et al. ..... 338/21
6,813,137 B2 * 11/2004 Matsuoka et al. ..... 361/305
7,075,404 B2 * 7/2006 Hirose et al. ..... 338/21

FOREIGN PATENT DOCUMENTS

| | | |
|---|---|---|
| CN | 1592939 | 3/2005 |
| JP | A 09-246017 | 9/1997 |
| JP | A-2004-140334 | 5/2004 |

OTHER PUBLICATIONS

Office Action issued on May 22, 209 in a counterpart Chinese patent application.
Office Action issued on Jul. 7, 2009 in a basic Japanese patent application.

* cited by examiner

*Primary Examiner*—Kyung Lee
(74) *Attorney, Agent, or Firm*—Oliff & Berridge, PLC

(57) ABSTRACT

A preferred varistor body has a structure of alternately laminated internal electrode layer and varistor layer made of a varistor material. The varistor layer has a composition containing Zn, Co, Pr, Li, and Zr. The analysis of varistor body in the depth direction from the surface thereof gives the Li content of 0.08 parts by mass or less to 100 parts by mass of the sum of Zn, Co, and Pr contents at a level of 2 μm at the surface side above the reference depth where the Zr content becomes almost constant.

2 Claims, 4 Drawing Sheets

VARISTOR BODY AND VARISTOR

BACKGROUND OF THE INVENTION

1. Field of the Invention

The present invention relates to a varistor body and a varistor having the same.

2. Related Background Art

Varistor is an element showing a voltage nonlinear characteristic which keeps insulation property with high resistance up to a certain voltage, and suddenly becomes a low resistance above that voltage to allow current to flow therethrough, (hereinafter referred to as the "varistor characteristic"). Utilizing the characteristic, the varistor is used as an element and the like for protecting circuit of electronics devices in case of generation of abnormal voltage (surge). In recent years, the varistor has become miniature scale, and is expected to be used as an inexpensive surge-protection element in digital cameras, mobile phones, and the like substituting for existing Zener diode.

Known varistors include a laminated type varistor having a structure of a varistor body prepared by laminating alternately a varistor layer providing the varistor characteristic and an internal electrode layer, and an external electrode which is attached to outside of the varistor body and is connected to the internal electrode layer. Other than that type, there is known an array type varistor having a structure of combining pluralities of above elements.

The varistors having above structures are often fixed and connected to printed circuit board and the like by soldering the external electrode. Ordinary external electrodes are, however, likely fused and dispersed into the solder, which likely induces connection failure. To cope with the drawback, conventional external electrodes are prepared with a substrate electrode and a plating layer of Ni and the like formed on the surface of the substrate electrode, thus improving the heat resistance. From the point of production cost and other variables, the formation of that type of plating layer is generally done by electroplating.

Since, however, the varistor body (varistor layer) has above-described semiconductor characteristic, the insulation resistance is inherently not so large. As a result, on applying electroplating, there are conventionally often occurred the formation of plating with running-over portion thereof from the range to form the substrate electrode, (that kind of phenomenon is hereinafter referred to as the "plating extension"), and the adhesion of plating to positions other than the substrate electrode, (that kind of phenomenon is hereinafter referred to as the "plating adhesion"). Those phenomena of plating extension and plating adhesion are not welcomed because they have become significant causes of short-circuit between external electrodes along with the recent movement of miniaturization of varistor.

To avoid the problem, there is a known countermeasure which covers the surface of varistor body, other than the external electrode, by an insulation coating layer such as glass coat. That type of countermeasure, however, requires forming the glass coat film at precise dimensions, which raises other problems such as complex production process and increased production cost.

Another countermeasure to attain good electroplating is disclosed as a method of diffusing Li or Na into a region in the vicinity of surface of the varistor body, (refer to Japanese Patent Application Laid-Open No. 9-246017). The method brings the region in the vicinity of the surface of varistor body to high resistance, thus suppressing the plating formation on other part than the substrate electrode.

SUMMARY OF THE INVENTION

There are, however, cases that the countermeasure disclosed in Japanese Patent Application Laid-Open No. 9-246017 cannot fully prevent the plating extension and plating adhesion during plating. In particular, when Li or Na is to diffuse into a deep region, there is a tendency of difficult to suppress the plating extension and plating adhesion.

The present invention has been derived to cope with the above situations, and an object of the present invention is to provide a varistor body that surely forms a varistor inducing little plating extension and plating adhesion. Another object of the present invention is to provide a varistor equipped with the varistor body of the present invention.

To achieve the above objects, the inventors of the present invention carried out detail studies, and found that the conventional varistor body has not-fully homogeneous composition in the region near the surface thereof, which non-homogeneity causes the above-described plating extension and plating adhesion. That is, since the composition of the region in the vicinity of the surface of the varistor body is not homogeneous, there are cases of presence of regions not fully becoming high resistance on the surface of the varistor body. During the plating treatment, there are occurred etching and elution on the surface of the varistor body. With a varistor body having a non-homogeneous composition in the vicinity of the surface of the varistor, however, uniform etching and elution are difficult to attain, which also likely induces plating extension and plating adhesion.

In particular for the case of Japanese Patent Application Laid-Open No. 9-246017, where Li or Na is to diffuse into deep region (10 μm from the surface) in the varistor body without directly adhering the diffusion source of Li or Na to the varistor body, the control of diffusing amount is difficult and the high resistance in the vicinity of the surface likely becomes not-uniform. As the method for diffusing Li or Na, there may be applied direct adhesion of these diffusion sources onto the surface of the varistor body, followed by applying heat treatment. In this case, however, to diffuse Li or Na into above-described deep region, it is necessary to let a large amount of Li or Na diffusion sources adhere onto the surface of the varistor body. The adhesion of that large amount of Li or Na diffusion sources, however, likely induces a reaction by the heat treatment in the vicinity of the surface of the varistor body, which may result in non-homogeneity in the composition near the surface.

In this regard, the inventors of the present invention conducted further studies on the basis of the above findings, and found that the regulation of the Li content at a region near the surface of the varistor body further surely decreases the plating extension and the plating adhesion, thus perfected the present invention.

That is, the varistor body of the present invention is the one containing a varistor material, wherein the varistor material has a composition containing Zn, Co, Pr, Li, and Zr, and an analysis of the varistor body in the depth direction from the surface thereof gives a Li content of 0.08 parts by mass or less to 100 parts by mass of the sum of Zn, Co, and Pr contents at a level of 2 μm above a reference depth where the Zr content becomes almost constant.

According to the varistor body of the present invention, when a depth from the surface, the depth coming to have almost constant Zr content, is defined as the reference depth, the Li content at a level of 2 μm above the reference depth is to be a specified value or less. With that type of varistor body, even a case of applying plating onto the substrate electrode significantly decreases the plating extension and the plating adhesion. Although the cause of the phenomenon is not fully analyzed, a presumable cause is given as follows. That is, the component elements in the varistor layer migrate caused by the reaction accompanied with the Li diffusion, which induces dispersion in composition and local differences in resistance at regions in the vicinity of the surface. The migrated elements become the nuclei of plating formation, thus resulting in the plating extension and the plating adhesion. That series of reactions presumably occurs together with the elution and etching on the surface of the varistor body during plating. To the contrary, according to the present invention, it is presumed that the Li content in a region near the surface above-described is specified to the above-given value or less, which suppresses the migration of elements in the vicinity of the surface of the varistor body, thus suppressing the plating extension and the plating adhesion. The action is, however, not limited to the one described above.

According to Patent Document 1, the concentration ratio of Li or Na between a region in the vicinity of the surface and a level of 10 μm depth from the surface is specified. However, the elution and etching of varistor body during plating very little reach the 10 μm depth. In addition, when the dimensional accuracy and other variables are considered, that excess elution and etching are not preferable. To the contrary, the varistor body according to the present invention specifies the Li content in a region which is closer to the surface than the depth of conventional varistor body, and specifies the Li content in a region where the elution and etching are able to occur during plating. Therefore, the varistor body according to the present invention favorably controls the elution and etching during plating, thus surely decreasing the plating extension and the plating adhesion.

According to the varistor body of the present invention, it is preferable that $L_1/L_2$ is in a range from 1 to 2.20, where $L_1$ signifies parts by mass of the Li content to 100 parts by mass of the sum of Zn, Co, and Pr contents at a level of 2 μm above the reference depth, and $L_2$ signifies parts by mass of the Li content to 100 parts by mass of the sum of Zn, Co, and Pr contents at the reference depth. That range of $L_1/L_2$ decreases the changes of Li content in the depth direction in a region in the vicinity of the surface, thus further decreasing the plating extension and the plating adhesion.

The varistor according to the present invention becomes preferable by providing the varistor body of the present invention, wherein the varistor has the varistor body according to the present invention, a substrate electrode formed on the surface of the varistor body, and a plating layer formed on the surface of the substrate electrode. Since the varistor having the structure is prepared by using the varistor body of the present invention, the plating extension and the plating adhesion occur very little, and failures such as short-circuit occur very little.

DESCRIPTION OF THE PREFERRED EMBODIMENTS

Figure 1:
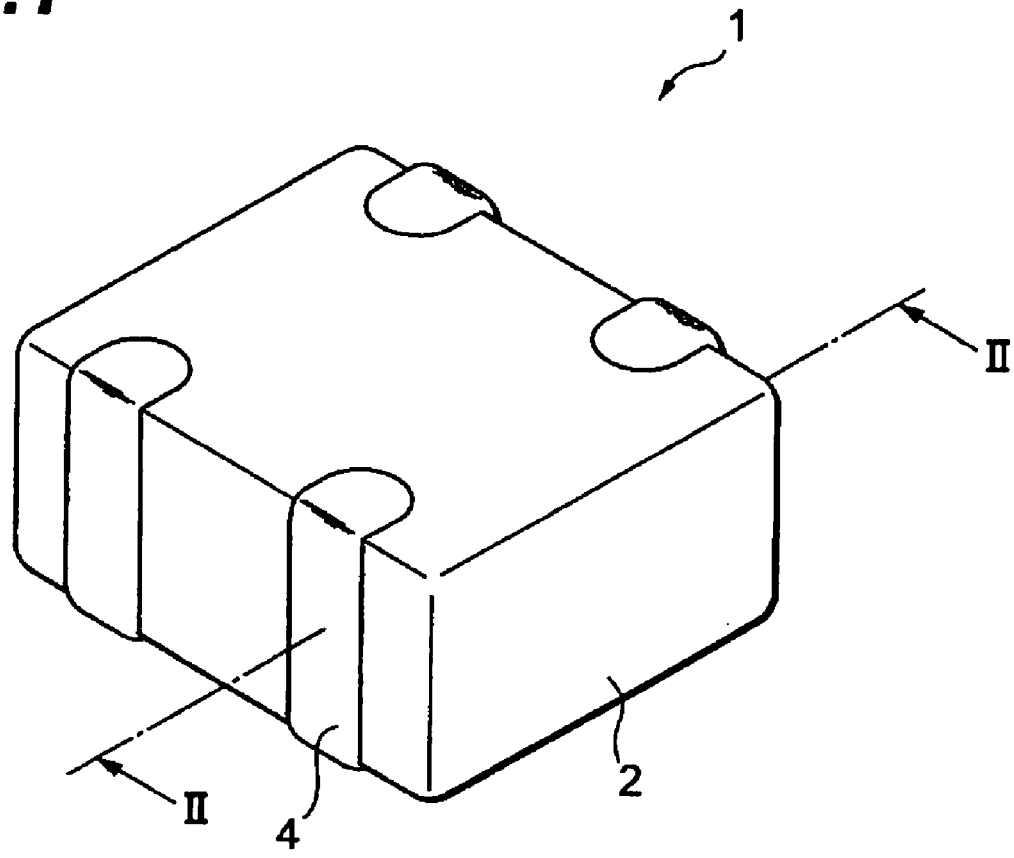
FIG. 1 is a perspective view of a varistor in a preferred embodiment

Preferred embodiments of the present invention will be described below referring to the drawings. In the description of the drawings, the same component is attached with the same reference numeral, and no duplicated description is given.

Figure 2:
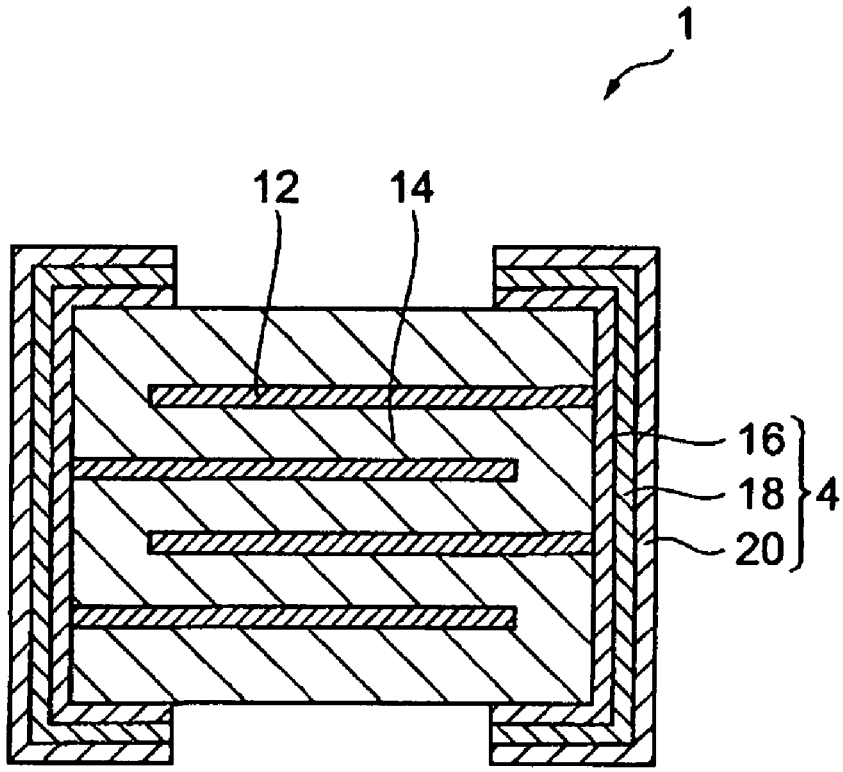
FIG. 2 is a schematic drawing of cross sectional structure along II-II line of the varistor in FIG. 1.

FIG. 1 shows a perspective view of a varistor of a preferred embodiment. FIG. 2 shows a schematic drawing of a cross sectional structure of the varistor along II-II line in FIG. 1.

As illustrated in FIG. 1, a varistor 1 is structured by a varistor body 2 in almost rectangular parallelepiped shape, and each two terminal electrodes 4 positioned on each of the opposing edge faces of the varistor body 2. The terminal electrodes 4 are positioned so as the one formed on an edge face of the varistor 2 to face the other formed on the other edge face thereof. Then, a portion being sandwiched between the opposing pair of terminal electrodes forms a single varistor. With the configuration, the varistor 1 is an array type varistor structured by combining substantially two varistors.

As illustrated in FIG. 2, in the varistor body 2, an internal electrode layer 12 and a varistor layer 14 are alternately arranged so as the varistor layer 14 to become outer side. In other words, the varistor body 2 has a structure that pluralities of internal electrode layers 12 are included in the structure of the varistor material prepared by laminating pluralities of varistor layers 14. The terminal electrode 4 has a three-layered structure of, in an order from the varistor 2 side, a substrate electrode 16, a first plating layer 18, and a second plating layer 20.

The plurality (four in this case) of internal electrode layers 12 are arranged in almost parallel with each other so as an edge part of the internal electrode layer 12 there each to expose alternately to the respective opposing edge faces of the varistor body 12. The internal electrode layers 12 contact with the respective substrate electrodes 16, at the exposed portion. With the configuration, the internal electrode layer 12 and the substrate electrode 16 are electrically connected with each other. The material for the internal electrode layer 12 is a conductive material normally used for the internal electrode layer of varistor without specific limitation, and Ag, Pd, Ag—Pd alloy, and the like are preferred. A preferable thickness of the internal electrode layer 12 is in a range from 0.5 to 5 μm.

The varistor layer 14 is made of a varistor material, and is a layer having a composition containing zinc (Zn), cobalt (Co), praseodymium (Pr), lithium (Li), and zirconium (Zr). More specifically, the varistor layer 14 is a layer containing zinc oxide (ZnO) as the main component, preferably 69.0 to 99.8% by mass of zinc oxide in the layer, with auxiliary components of Co, Pr, Li, and Zr as single metal or oxide thereof. In the varistor layer 14, these auxiliary components are not necessarily dispersed uniformly in the layer, and they may exist locally. Adding to the above components, the varistor layer 14 may further contain trace amount of other rare earth elements, III group elements (B, Al, Ga, In, and the like), alkali metal elements (K, Rb, Cs, and the like), and alkali earth metal elements (Mg, Ca, Sr, Ba, and the like). A preferable thickness of the varistor layer 14 is in a range from 5 to 100 μm.

The substrate electrode 16 formed on each opposing edge face of the varistor body 2 is made of a material which can attain good electric connection with the internal electrode layer 12, and a preferable material thereof includes Ag, Pd, Pt, and alloy of them. The first plating layer 18 and the second plating layer 20 formed on the surface of the substrate electrode 16 include a nickel (Ni) plating layer and a tin (Sn) plating layer. With these plating layers, the connection with the external substrate and the like of the varistor 1 becomes advantageous compared with the structure of sole substrate electrode 16, and the heat resistance and other characteristics of the terminal electrode 4 improve.

The varistor 1 of the embodiment has the above structure. The varistor body 2 in the varistor 1, (the structure made of the varistor material), is formed so as the Li content in a region in the vicinity of the surface to satisfy the following conditions.

That is, an analysis of the contents of elements forming the varistor layer 14 in the depth direction from the surface of the varistor body 2 gives the Li content of 0.08 parts by mass or less to 100 parts by mass of the sum of Zn, Co, and Pr contents at a level 2 μm above (shallower than) the depth where the Zr content becomes almost constant, (that depth is defined as the "reference depth").

The contents of elements in the varistor body 2 can be determined by a laser abrasion-ICP-mass spectrometer (LA-ICP-MS). The measurement is conducted by detecting the element under laser irradiation to the varistor body 2, (under the condition of 20 μM of wavelength and 10 Hz of frequency), while forming a hole (about 100 μm in diameter) from the surface in the depth direction, then by determining the sensitivity of the element at each depth. Thus obtained sensitivity of each element can be converted to the composition (mass ratio) by the correction with the sensitivity coefficient for the element concerned. Based on the obtained composition value, the content of each element (% by mass) at each depth is calculated.

Figure 3:
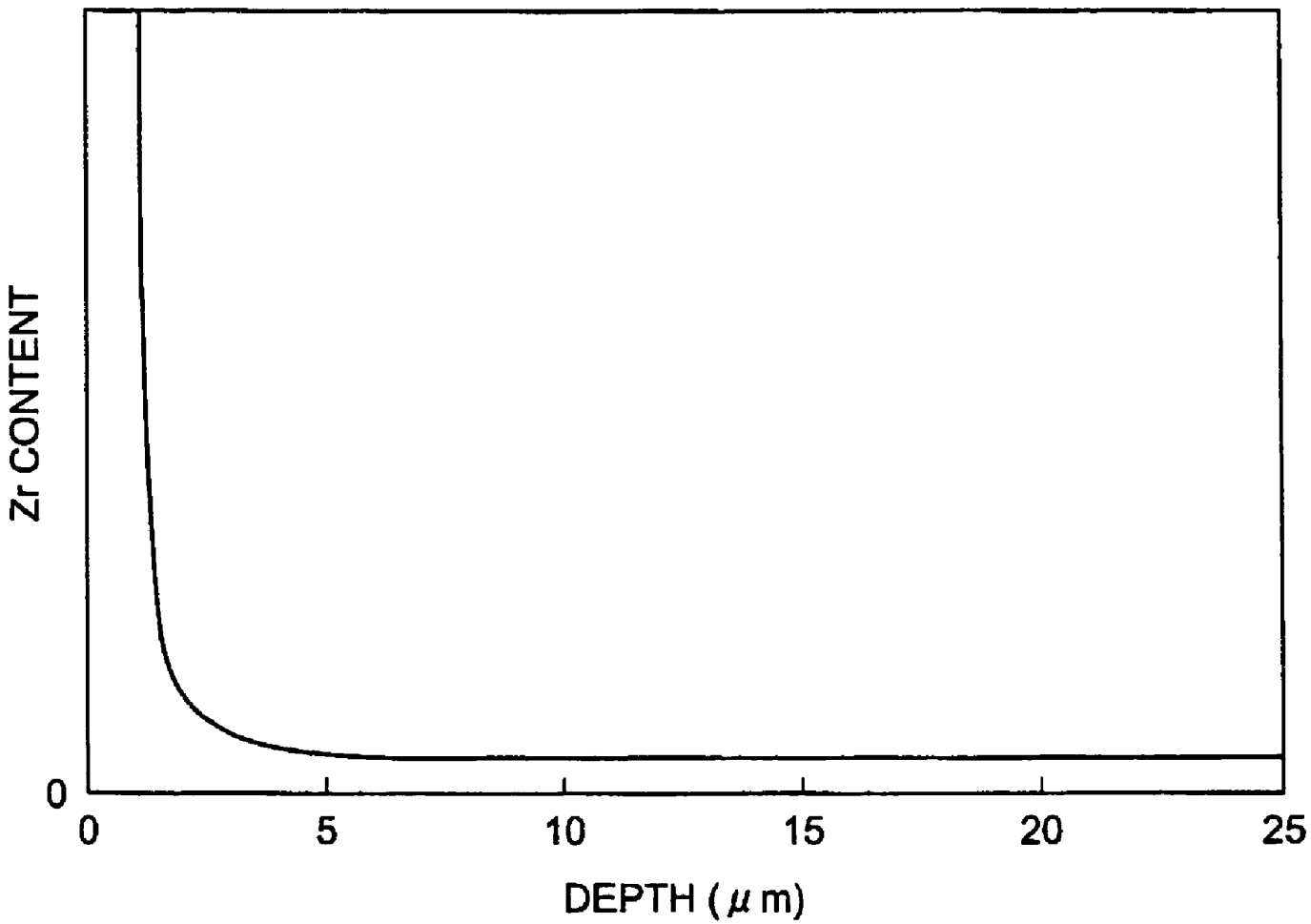
FIG. 3 is a graph showing an example of determination of Zr content in the depth direction from the surface of a varistor body 2.

The "depth (μm)" from the surface can be defined as the value which is calculated from the laser irradiation time in the above measurement and from the average rate of cutting the varistor body 2 in the depth direction by the laser. The "depth where the Zr content becomes almost constant" signifies the minimum depth, under the comparison between the Zr content at a level concerned and the Zr content at sufficiently deeper level, giving almost equal (within differences of about ±3%) Zr content. The depth of sufficiently deep may be the depth of 10 to 25 μm from the surface of the varistor body 2. As an example, FIG. 3 shows the observed graph of Zr content in the depth direction from the surface of the varistor body 2. As seen in the figure, the Zr content decreases with the depth of the varistor body 2 from the surface, and reaches almost constant value at a certain depth.

In the varistor body 2, by specifying the Li content at a specified depth from the surface as above, the surface of the varistor body 2 uniformly and favorably becomes high resistance. As a result, even the first plating layer 18 or the second plating layer 20 are formed on the substrate electrode 16, the plating extension and the plating adhesion come to hardly occur.

To further surely obtain the above effect, the Li content at a level of 2 μm at the surface side above the reference depth of the varistor body 2 is preferably 0.08 parts by mass or less to 100 parts by mass of the sum of Zn, Co, and Pr contents, and more preferably 0.05 parts by mass or less. If, however, the Li content at the level is excessively small, the surface of the varistor body 2 fails to become sufficiently high resistance, in some cases. Accordingly, the Li content at above depth level is preferably 0.007 parts by mass or more, and more preferably 0.01 parts by mass or more to 100 parts by mass of the sum of Zn, Co, and Pr contents.

In a region in the vicinity of the surface of the varistor body 2, it is preferable that the Li content is uniform to some degree in the depth direction Specifically, it is preferable that $L_1/L_2$ is 2.20 or less, and more preferably 1.83 or less, where $L_1$ is parts by mass of the Li content to 100 parts by mass of the sum of Zn, Co, and Pr contents at a level of 2 μm at the surface side above the reference depth, and $L_2$ is parts by mass of the Li content to 100 parts by mass of the sum of Zn, Co, and Pr contents at the reference depth. As described later, since Li diffuses from the surface of the varistor body 2, the minimum value of $L_1/L_2$ is normally one.

By thus uniformizing the Li content in the vicinity of the surface in the depth direction, at the time of heat treatment for Li diffusion, the migration of elements in the vicinity of the surface of the varistor body 2 occurs uniformly, which further prevents the generation of differences in the local resistance in the vicinity of the surface. As a result, the plating extension and the plating adhesion on forming the plating layers (first and second) on the substrate electrode 16 become further small.

As the varistor body 2, the above reference depth is preferably in a range from 2 to 10 μm from the surface. A varistor body 2 which has the reference depth deeper than 10 μm likely induces non-homogeneous composition in the vicinity of the surface, and the migration of elements in the vicinity of the surface likely occurs independent of the Li content.

Figure 4:
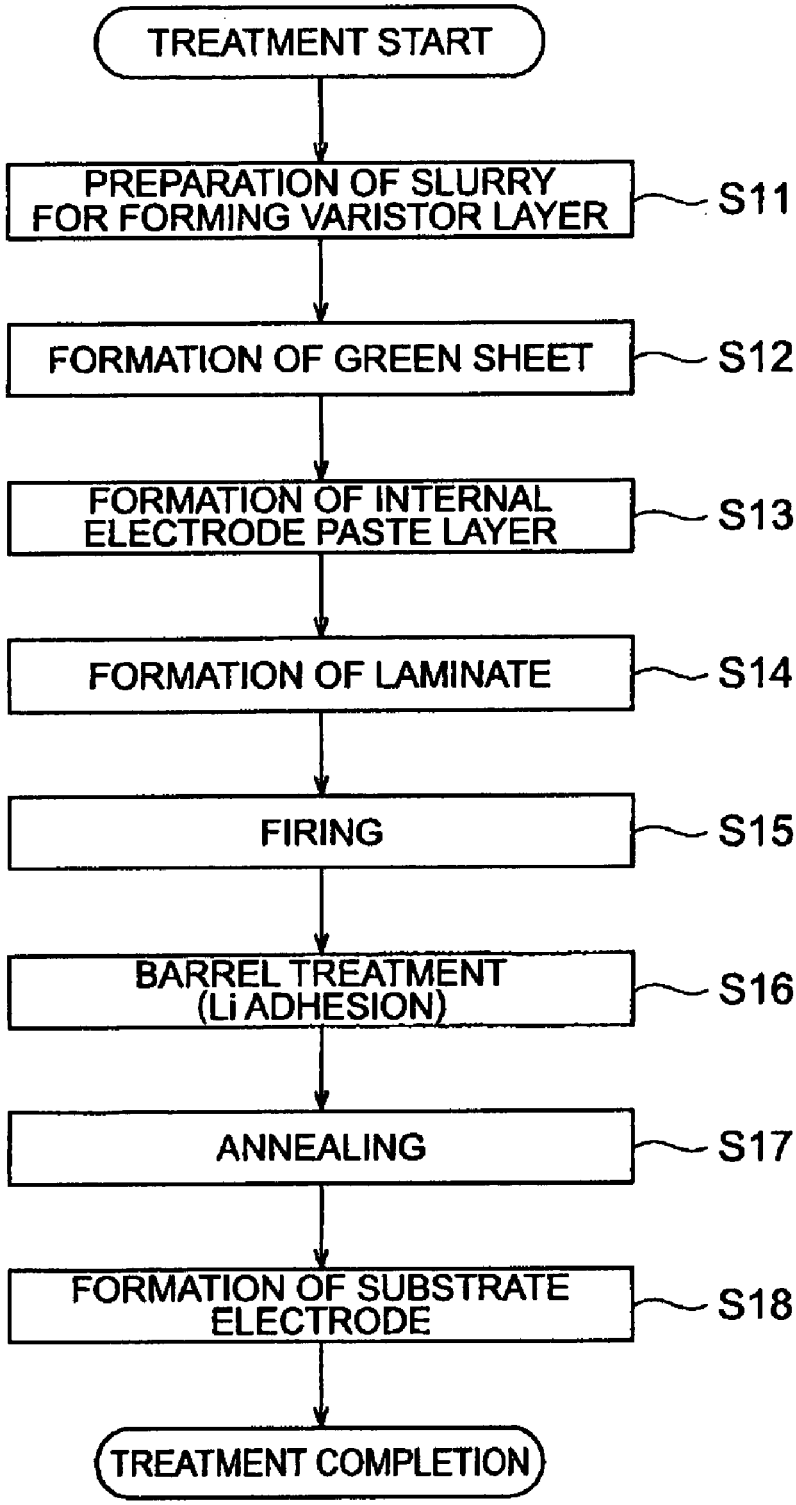
FIG. 4 is a flow chart of a preferred manufacture process of varistor 1.

A preferred manufacturing method of the varistor 1 having above structure will be described below. FIG. 4 is a flow chart of a preferred manufacturing process of the varistor 1.

For manufacturing the varistor 1, a slurry to form the varistor layer, (slurry for forming the varistor layer), is prepared, (Step S11). In the step, ZnO which is the main component of the varistor layer 2, and other components including Co, Pr, Zr, and the like which are the auxiliary components thereof are weighed to obtain a desired composition, which are then mixed together. An organic binder, an organic solvent, an organic plasticizer, and the like are added to the mixed components, which are blended together to obtain the slurry for forming the varistor layer. Since the Li which is an essential component of the varistor layer 14 is added to the varistor body 2 in the step described below so that the Li is not added in this step.

Then, thus prepared slurry for forming the varistor layer is applied onto a base film such as polyethylene terephthalate (PET) using a known method such as doctor blade method. The applied slurry is dried to form a film having about 30 μm in thickness. Thus formed film is peeled off from the PET film to obtain a green sheet, (Step S12).

A paste for forming the internal electrode is prepared by mixing an organic binder and the like with a metallic material powder such as Ag—Pd alloy that structures the internal electrode layer. Thus prepared paste is printed on the green sheet by the screen-printing process or the like, which is then dried to form the internal electrode paste layer having a specified pattern thereon, (Step S13).

After preparing a specified number (four in this embodiment) of the green sheets on which the respective internal electrode paste layers are formed, they are arranged and laminated so as the individual internal electrode paste layers become the same side to the respective green sheets. After covering the internal electrode paste layer which is exposed to outermost side with a green sheet on which no internal electrode paste layer is formed, the entire structure is pressed to form a laminate. By cutting the laminate to a desired size, the green chip is obtained, (Step S14). The obtained green chip is dried, as needed, by heating or other means.

After that, the green chip is subjected to heat treatment at approximately 180° C. to 400° C. for about 0.5 to 24 hours as the binder-removal treatment to remove the binder and the solvent from the individual layers, followed by further firing at approximately 1000° C. to 1400° C. for about 0.5 to 8 hours, (Step S15), thus forming the varistor body 2. The firing forms the internal electrode layer 12 from the internal electrode paste layer in the green chip, and the varistor layer 14 is formed from the green sheet.

Next, the barrel treatment is given to the varistor body 2, (Step S16). The barrel treatment uses a medium, while coexisting with a Li compound during the treatment, thus letting the Li diffusion sources adhere to the surface of the varistor body 2. That type of barrel treatment can be done in the following procedure.

The varistor body 2 and a Li compound as the Li diffusion source are placed in a pot containing the medium. The Li compound may be an oxide, hydroxide, chloride, nitrate, borate, or carbonate of Li. Then, the pot is rotated or subjected to other means to agitate the varistor body 2, the medium, and the Li compound, thus to bring the Li compound adhere to the surface of the varistor body 2. The quantity of adhered Li compound can be varied by adjusting the amount of medium, the diameter of medium, the number of the varistor bodies 2 being treated at a time, the added amount of Li compound, and other variables.

The quantity of adhered Li compound in the barrel treatment is, for example with $Li_2CO_3$ as the Li compound, preferably in a range from 0.01 to 100 μg per 1 $mm^2$ of surface area of the varistor body 2, and more preferably from 0.1 to 10 μg. With that range, the Li content in the annealing step described later becomes easily adjustable.

To the varistor body 2 after finishing the barrel treatment, annealing treatment is applied, (Step S17). When the Li compound adheres to the surface of the varistor body 2, the annealing treatment diffuses the Li into the varistor body 2 from the surface utilizing the adhered Li compound as the diffusion source. The annealing treatment is preferably done by arranging the varistor body 2 in a desired vessel to heat the varistor body 2 to an approximate temperature range from 700° C. to 1000° C. for about 10 minutes to 2 hours. The annealing condition can be appropriately adjusted responding to the Li adhesion quantity and to the desired degree of diffusion.

Then, the substrate electrode paste containing mainly a metallic material to structure the substrate electrode is applied onto a desired position on the surface of the varistor body 2. The paste is subjected to heat treatment at about 550° C. to about 850° C., (baking). Thus the substrate electrode 16 is formed on the opposing edge faces on the varistor body 2, (Step S18).

On the surface of the substrate electrode 16, plating is given, for example in the order of Ni plating and Sn plating, by electroplating or the like, thus forming the first plating layer 18 and the second plating layer 20, respectively. Through the procedure, the varistor 1 having the structure shown in FIG. 1 and FIG. 2 is obtained.

The above description is given to the varistor body, the varistor, and the method of manufacturing thereof according to a preferred embodiment of the present invention. The present invention, however, is not limited to the above embodiment. For example, the above embodiment deals with an example of varistor array having substantially two varistors. The present invention is not limited to the structure but may be a single varistor, or a varistor array structured by three or more of varistors. In addition, the embodiment showed an example of varistor in a laminated form having alternately laminating the varistor layer and the internal electrode layer. For example, however, a single layer type arranging a varistor layer between a pair of electrodes may be adopted.

According to the manufacturing method in the embodiment, the Li compound adheres onto the surface of the varistor body 2 during the barrel treatment, and then the annealing is given for diffusing the Li into the varistor body 2. The method of diffusing Li is, however, not limited to the method. For instance, the annealing treatment given under the diffusion condition of existence of the Li diffusion source in gas phase can also diffuse the Li in the varistor body. In that case, during the barrel treatment before the annealing treatment, the Li compound may or may not adhere to the varistor body.

EXAMPLES

The present invention will be described below in more detail referring to the examples. The present invention is, however, not limited to these examples.

[Manufacture of Varistor Body]

A large number of varistor bodies were manufactured following the steps S11 to S17 given in FIG. 4. The combinations of the firing condition (Step S15) and the annealing condition (Step S17) were varied to 8 types, thus manufactured varistor bodies in 8 groups. These groups were named respectively as the Manufacture Examples 1 to 8 depending on the combinations of firing condition and annealing condition as described below.

In these manufacturing examples, the material for forming the varistor layer was the one containing ZnO of 99.9% purity (99.725% by mole) with the addition of 0.5% by mole of Pr, 1.5% by mole of Co, 0.005% by mole of Al, 0.05% by mole of K, 0.1% by mole of Cr, 0.1% by mole of Ca, 0.02% by mole of Si, and 0.01% by mole of Zr. The material for forming the internal electrode layer was an Ag—Pd alloy. The raw material for diffusing Li, (Li compound), into the varistor body was $Li_2CO_3$. The use amount of the $Li_2CO_3$ was 1 μg per a single varistor body.

Manufacture Examples 1 to 5

The firing was conducted by total 14 hours of treatment containing the steps of heating the varistor body to 1200° C. at a heating rate of 200° C./hr, of holding the varistor body at the temperature of 1200° C. for 2 hours, and of cooling the varistor body at a cooling rate of 200° C./hr. The annealing was conducted under the conditions of heating the varistor body to 850° C. in 20 minutes, holding the varistor body at the temperature of 850° C. for 20 minutes, and then cooling the varistor body to the original temperature in 20 minutes. That is, Manufacture Examples 1 to 5 were the group subjected to firing and annealing under the same condition.

Manufacture Example 6

The firing and the annealing were given under the same condition as that of Manufacture Examples 1 to 5. However, instead of the method of Li diffusion to the varistor body by annealing after adhering the Li compound in the barrel treatment, Manufacture Example 6 conducted the Li diffusion in gas phase not by the method of adding the Li compound in the barrel treatment but by the method of coexistence of $Li_2CO_3$ in the furnace in the annealing.

Manufacture Example 7

The firing was conducted by total 13 hours of treatment containing the steps of heating the varistor body to 1200° C.

at a heating rate of 200° C./hr, of holding the varistor body at the temperature of 1200° C. for 1 hour, and of cooling the varistor body at a cooling rate of 200° C./hr. The annealing was conducted under the conditions of heating the varistor body to 850° C. in 20 minutes, holding the varistor body at the temperature of 850° C. for 20 minutes, and then cooling the varistor body to the original temperature in 20 minutes. Furthermore, Manufacture Example 7 conducted the Li diffusion in the varistor body by the same method as that in Manufacture Example 6.

Manufacture Example 8

The firing was conducted by total 13 hours of treatment containing the steps of heating the varistor body to 1200° C. at a heating rate of 200° C./hr, of holding the varistor body at the temperature of 1200° C. for 1 hour, and of cooling the varistor body at a cooling rate of 200° C./hr. The annealing was conducted under the same condition as that in Manufacture Examples 1 to 5.

[Determination of Li Content at a Specified Depth]

Each several samples of varistor body were taken from each group of varistor bodies in Manufacture Examples 1 to 8. On the portion of varistor layer exposed on the surface of each of the sampled varistor bodies, the analysis in depth direction from the exposed surface of varistor layer was given using LA-ICP-MS (LUV266X made by New Wave Research, Inc. for laser section; and Agilent 7500S made by Yokogawa Analytical Systems Co., Ltd. for ICP-MS section).

Based on the obtained results, there was calculated the Li content (parts by mass to 100 parts by mass of the sum of Zn, Co, and Pr contents, expressed by "$L_1$" in the table) at a level of 2 μm at the surface side above the reference depth where the Zr content becomes almost constant. Among the values obtained from the plurality of varistor bodies for each manufacture example, the minimum value and the maximum value are given in Table 1.

TABLE 1

| | $L_1$ (parts by mass) | |
|---|---|---|
| | (Minimum value) | (Maximum value) |
| Manufacture Example 1 | 0.008 | 0.022 |
| Manufacture Example 2 | 0.012 | 0.044 |
| Manufacture Example 3 | 0.013 | 0.044 |
| Manufacture Example 4 | 0.015 | 0.080 |
| Manufacture Example 5 | 0.012 | 0.019 |
| Manufacture Example 6 | 0.007 | 0.010 |
| Manufacture Example 7 | 0.084 | 0.188 |
| Manufacture Example 8 | 0.084 | 0.117 |

[Determination of Percent Defective]

Each 5000 samples of varistor body were taken out from each group of varistor bodies in the respective Manufacture Examples 1 to 8. With each sampled varistor body, the varistor was manufactured following the procedure described below. That is, the varistor body was subjected to Step S18 given in FIG. 4, thus forming a substrate electrode. Then, electroplating was applied to the surface of the substrate electrode in the order of Ni plating and Sn plating to form the plating layer, thereby completing the varistor.

For all of thus prepared varistor bodies, there was confirmed whether the plating extension (forming a plating layer with running-over portion thereof from the range to form the substrate electrode) occurred or whether the plating adhesion (the adhesion of plating to positions other than the region of forming substrate electrode) occurred. The varistor body on which no plating extension or plating adhesion occurred was defined as the non-defective. Thus, the fraction non-defective (%) in the 5000 varistors for each manufacture example was calculated. The result is given in Table 2. The case that the plating with running-over portion thereof from the range to form the substrate electrode by a distance of more than 20 μm was judged as the "plating extension", and the case that a plating larger Man 20 μm in diameter adheres to the surface of the varistor body other than the region for forming the substrate electrode was judged as the "plating-adhesion".

TABLE 2

| Varistor | Percentage non-defective (%) |
|---|---|
| Manufacture Example 1 | 94.7 |
| Manufacture Example 2 | 95.8 |
| Manufacture Example 3 | 92.0 |
| Manufacture Example 4 | 92.7 |
| Manufacture Example 5 | 95.9 |
| Manufacture Example 6 | 95.5 |
| Manufacture Example 7 | 49.2 |
| Manufacture Example 8 | 57.4 |

From Table 2, it was confirmed that the varistor bodies in Manufacture Examples 1 to 6, in which $L_1$ was 0.080 or less, showed higher than 90% of the percentage non-defective and generated very little plating extension and plating adhesion, and that the varistor bodies in Manufacture Examples 7 and 8, which had a portion of $L_1$ above 0.084, gave significantly low percentage non-defective and likely generated plating extension and plating adhesion.

[Determination of the Ratio of Li Content Between Two Different Depth Levels]

Each several samples of varistor body were taken out from each group of varistor bodies in Manufacture Examples 2, 4, 5, and 8. On the portion of varistor layer exposed on the surface of each of the sampled varistor bodies, the analysis in depth direction from the surface was given using LA-ICP-MS similar to the above examples.

Based on the obtained results, there was determined the Li content (parts by mass to 100 parts by mass of the sum of Zn, Co, and Pr contents, expressed by "$L_1$" in the table) at a level of 2 μm above the reference depth, and the Li content (parts by mass to 100 parts by mass of the sum of Zn, Co, and Pr contents, expressed by "$L_2$" in the table) at the reference depth. Thus the value of $L_1/L_2$ for each varistor body was calculated.

Those determinations were given, in a state of holding the body in a vessel during annealing treatment, for both the face positioned upper side, (expressed by "A face" in the table) and the face positioned lower side (the face adhered to the bottom of the vessel, expressed by "B face" in the table). Among the values of $L_1/L_2$ for each face, obtained from pluralities of varistor bodies in each manufacture example, the minimum value and the maximum value are given in Table 3.

TABLE 3

| | $L_1/L_2$ | | | |
|---|---|---|---|---|
| | A face | | B face | |
| | (Minimum value) | (Maximum value) | (Minimum value) | (Maximum value) |
| Manufacture Example 2 | 1.17 | 1.49 | 1.13 | 1.83 |
| Manufacture Example 4 | 1.12 | 2.20 | 1.14 | 1.99 |

TABLE 3-continued

| | $L_1/L_2$ | | | |
|---|---|---|---|---|
| | A face | | B face | |
| | (Minimum value) | (Maximum value) | (Minimum value) | (Maximum value) |
| Manufacture Example 5 | 1.18 | 1.43 | 1.00 | 1.30 |
| Manufacture Example 8 | 2.33 | 2.65 | 1.21 | 1.53 |

[Evaluation of Local or Whole Area Adhesion of Plating]

Each 50 samples of varistor body were taken out from each group of varistor bodies in Manufacture Examples 2, 4, 5, and 8. The respective varistors were manufactured from the respective sampled varistor bodies using the same procedure as above.

Observation was given to each of thus manufactured varistors to confirm whether the plating adhered to local or the whole area on the surface. The "plating adhered to local area" signifies the state that the plating adheres in a part of the surface of the varistor body except for the region for forming the substrate electrode, and the "plating adhered to the whole area" signifies the state that the plating adheres covering almost all the surface area.

For the varistors manufactured from the varistor bodies in Manufacture Examples 2, 4, and 5, in which $L_1/L_2$ was 2.20 at the maximum, the varistors on which the plating adhering to local area or to the whole area gave 1.3% at the maximum, which percentage is very low. On the other hand, for the varistors manufactured from the varistor bodies in Manufacture Example 8, having a portion of $L_1/L_2$ above 2.33, the varistors on which the plating adhering to local area or to the whole area gave as large as 78%, in a state that the plating adhesion was visually confirmed.

According to the present invention, there is provided a varistor body which surely forms a varistor with very little plating extension and plating adhesion, and provided a varistor equipped with the varistor body.

What is claimed is:

1. A varistor body containing a varistor material, wherein the varistor material has a composition containing Zn, Co, Pr, Li, and Zr, and an analysis of the varistor body in the depth direction from the surface thereof gives a Li content of 0.08 parts by mass or less to 100 parts by mass of the sum of Zn, Co, and Pr contents at a level of 2 μm at the surface side above a reference depth where the Zr content becomes almost constant, wherein $L_1/L_2$ is in a range from 1 to 2.20, where $L_1$ signifies parts by mass of the Li content to 100 parts by mass of the sum of Zn, Co, and Pr contents at a level of 2 μm at the surface side above the reference depth, and $L_2$ signifies parts by mass of the Li content to 100 parts by mass of the sum of Zn, Co, and Pr contents at the reference depth.

2. A varistor comprising:

the varistor body according to claim 1, a substrate electrode formed on the surface of the varistor body; and a plating layer formed on the surface of the substrate electrode.

* * * * *